US006932029B2

(12) United States Patent
Ranganathan et al.

(10) Patent No.: US 6,932,029 B2
(45) Date of Patent: Aug. 23, 2005

(54) COOLANT PUMP CAVITATION SUPPRESSOR

(75) Inventors: Raj P. Ranganathan, Rochester Hills, MI (US); Edward J. Cryer, III, Lockport, IL (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 158 days.

(21) Appl. No.: 10/626,510

(22) Filed: Jul. 24, 2003

(65) Prior Publication Data

US 2005/0016473 A1 Jan. 27, 2005

(51) Int. Cl.[7] ..... F01P 5/10
(52) U.S. Cl. ..... 123/41.44; 137/888; 415/119
(58) Field of Search ..... 123/41.44; 137/888, 137/565.17, 565.18; 415/119, 176, 208.1; 239/592, 593, 594; 138/26, 30

(56) References Cited

U.S. PATENT DOCUMENTS 6,698,924 B2 * 3/2004 McCarthy et al. ..... 378/200

* cited by examiner

*Primary Examiner*—Noah P. Kamen
(74) *Attorney, Agent, or Firm*—Cook, Alex, McFarron, Manzo, Cummings & Mehler, Ltd.

(57) ABSTRACT

An engine cooling system includes a centrifugal coolant pump and a cavitation suppressor in the system upstream of the pump inlet. The suppressor increases pressure in the pump inlet by a converging nozzle that accelerates a jet of coolant at the location of the static head and converting kinetic energy of the jet to increased pressure in a diffuser. In an exemplary embodiment, the suppressor is formed of simple components made from available materials and preferably welded into an assembly. A machined nozzle with a diffuser and head pipe made from available steel pipe comprise the main components of the exemplary cavitation suppressor.

9 Claims, 3 Drawing Sheets

COOLANT PUMP CAVITATION SUPPRESSOR

TECHNICAL FIELD

This invention relates to engine cooling systems and, more particularly to a coolant pump cavitation suppressor for use in such systems.

BACKGROUND OF THE INVENTION

It is known in the art relating to engine cooling systems utilizing centrifugal coolant pumps to provide positive pressure at the inlet of a pump to extend the speed and temperature conditions under which the pump may be operated without cavitation occurring at the pump inlet, in other words, to suppress cavitation. Positive inlet pressure may be provided by a head of water or coolant obtained, for example, by mounting a coolant tank at a desired height above the pump inlet, so that the weight of the column of water provides a pressure head. Alternatively, the cooling system may be pressurized.

In a known application for railway locomotives having a relatively low coolant tank mounting, the coolant system has been pressurized in operation by the addition of a water inlet tee shown in FIG. 6 and formed similar to a jet pump or aspirator but functioning to increase the pump inlet pressure. The prior inlet tee utilized a straight sided nozzle for projecting a jet of water, or coolant, into a chamber to which the coolant tank was connected and which discharged into a diverging diffuser connected to the pump inlet. The pressure head supplied by the tank was thereby supplemented at the diffuser inlet by conversion of some of the dynamic head of the water jet into increased inlet pressure at the pump inlet.

Operation of the inlet tee was satisfactory, however, it was formed as a single casting, which, for differing applications, required provision of expensive casting dies. An improved design was desired which would reduce complexity and modification costs while providing equivalent or improved performance in engine applications.

SUMMARY OF THE INVENTION

The present invention provides a new cavitation suppressor which provides the results of the prior inlet tee but is simplified for fabrication from available materials at reduced cost. The suppressor of the invention includes a converging inlet nozzle, a straight sided diffuser and a similar head pipe with flange connector, all designed for ease of fabrication by welding into an assembly. However, the suppressor could alternatively be made as a simplified integral casting if desired.

The converging inlet nozzle may be machined from steel or other suitable material, or formed as a simple casting if desired. The nozzle is preferably conical for ease of machining and includes an inlet flange for connection in the cooling system. The converging nozzle elevates the kinetic energy of the coolant at the diffuser, which the diffuser converts to higher pump inlet pressure.

The diffuser is a section of steel pipe that is welded to the outlet end of the nozzle and is provided with a side opening immediately adjacent the nozzle outlet end for attachment of the head pipe The head pipe is also a pipe section having a connecting flange at the upper end for connection to the coolant tank. The diffuser is preferably straight sided but the head pipe may be curved to suit the application.

The cavitation suppressor may be applied in a cooling system similar to those of prior locomotive systems, but is not limited to such applications and could be applied in any system where amplification of the effective static pump inlet pressure is desired for cavitation suppression.

These and other features and advantages of the invention will be more fully understood from the following description of certain specific embodiments of the invention taken together with the accompanying drawings.

BRIEF DESCRIPTION OF THE DRAWINGS

FIG. 5 is a fragmentary cross-sectional view along the line 5—5 of FIG. 4, while

DESCRIPTION OF THE PREFERRED EMBODIMENT

Figure 1:
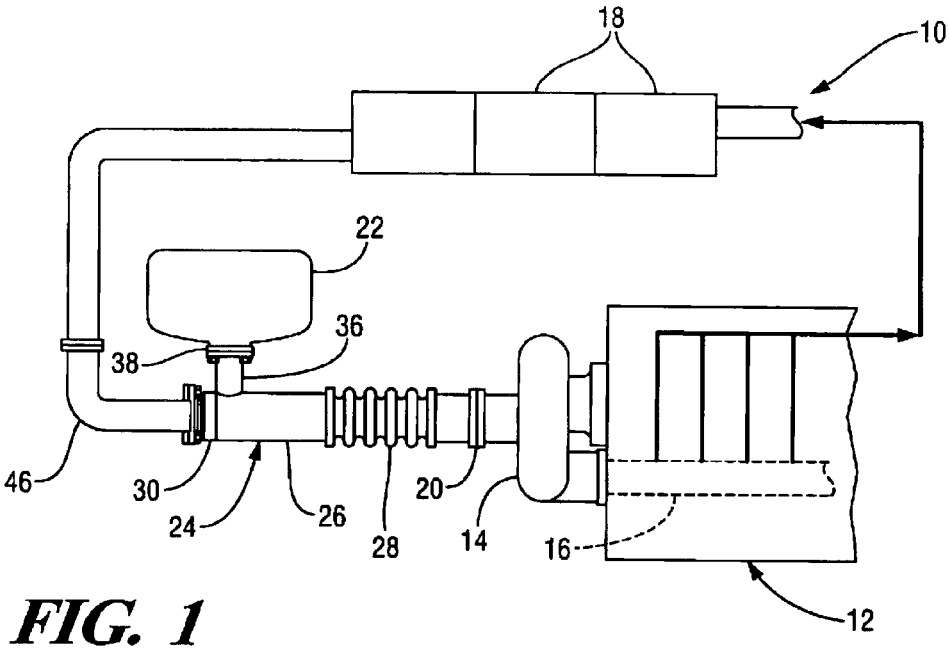
FIG. 1 is a simplified schematic diagram of a railway locomotive engine cooling system showing the manner of application of the cavitation suppressor of the invention.
Figure 2:
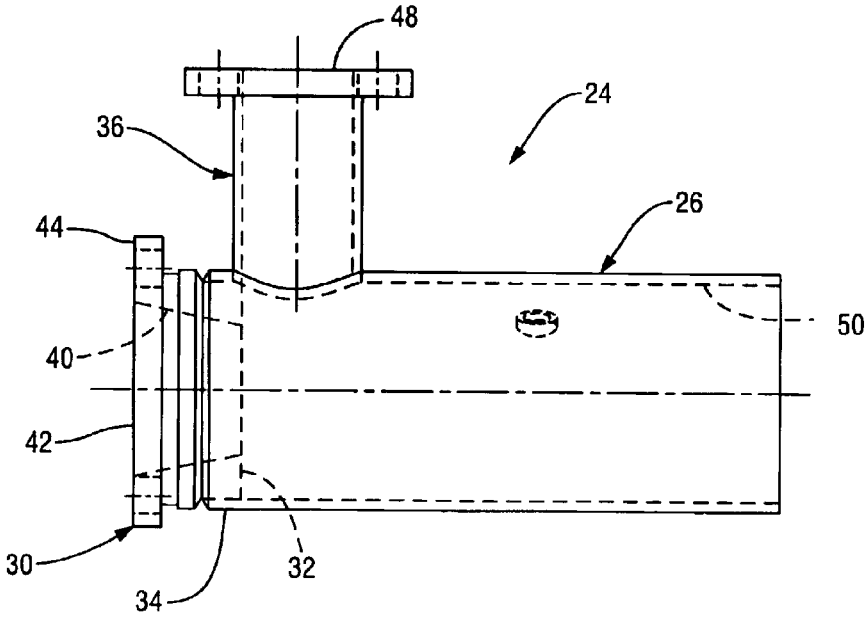
FIG. 2 is a side view of one embodiment of cavitation suppressor.
Figure 3:
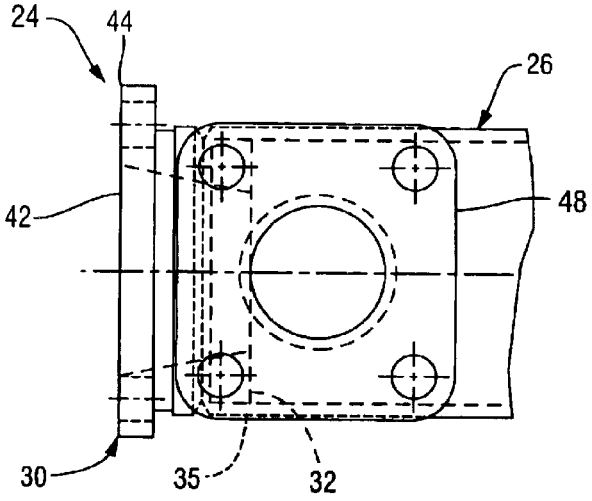
FIG. 3 is a top view of the suppressor of FIG. 2.
Figure 4:
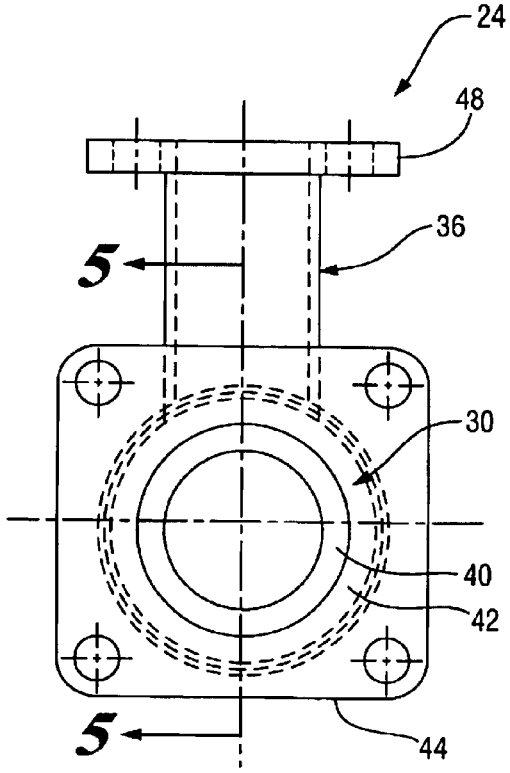
FIG. 4 is an inlet end view of the suppressor.
Figure 5:
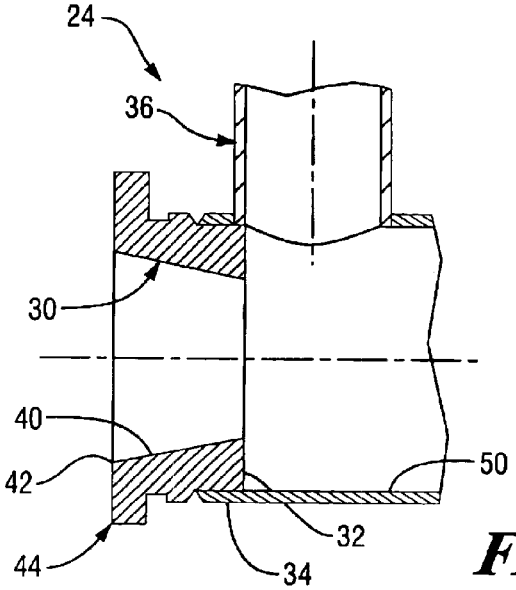
Figure 6:
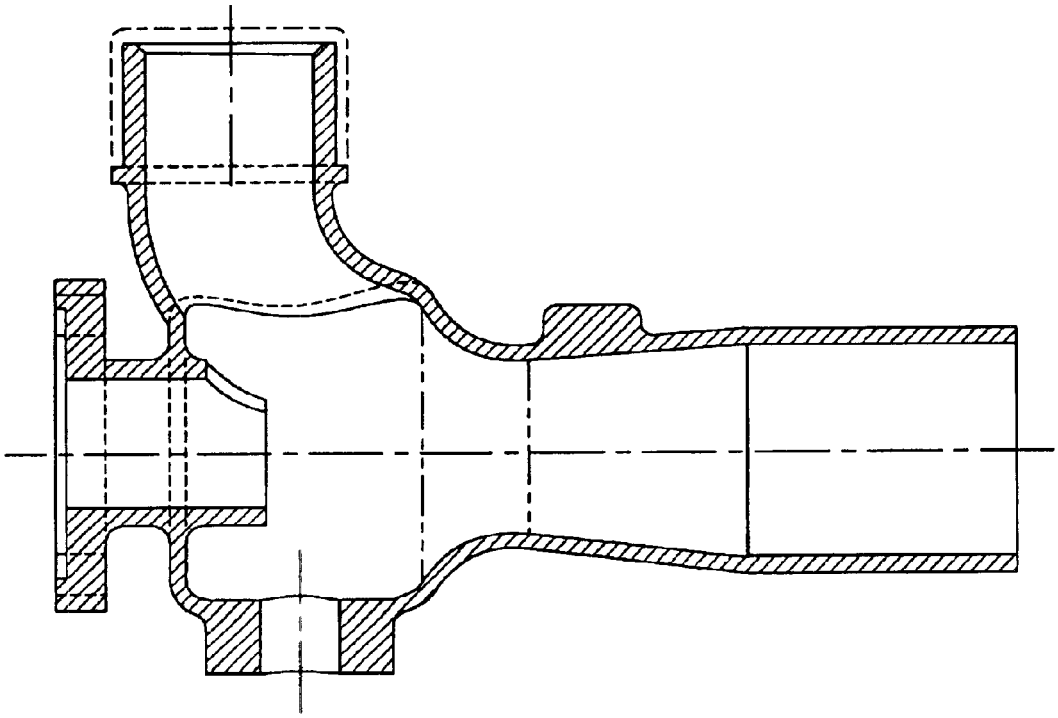
PRIOR ART FIG. 6
FIG. 6 is a cross-sectional view of a prior art water inlet tee described in the Background of the Invention as used in railway locomotives.

Referring now to the drawings in detail, numeral 10 generally indicates significant portions of an engine cooling system for a diesel railway locomotive. System 10 includes an engine 12 carrying an engine driven centrifugal water or coolant pump 14 and having internal coolant passages 16 for cooling internal components of the engine, as is known. Passages 16 connect externally with heat exchangers, such as radiators 18, for removing heat from the coolant in the system. The radiators are in turn connected with an inlet 20 of the coolant pump 14. Additional components, such as an oil filter and an oil cooler, not shown, would also be included in the system.

The cooling system further includes a water or coolant tank 22 mounted on a rack, not shown, at a height above the inlet 20 of the coolant pump 14. A cavitation suppressor 24 is provided including a diffuser pipe 26 connected through a flexible coupling 28 with the pump inlet 20. A converging inlet nozzle 30 of the suppressor has an outlet end 32 connected to a larger inlet end 34 of the diffuser pipe 26. A head pipe 36 of the suppressor connects a lower flange 38 of the coolant tank 22 with the diffuser pipe at a location immediately adjacent the outlet end 32 of the nozzle 30.

The nozzle defines an interior passage 40 converging with reducing cross-sectional areas from an inlet end 42 to the outlet end 32, although other converging nozzle configurations could be used, if desired. Passage 40 is preferably made conical, as shown, for ease of manufacture. The inlet end 42 of the nozzle includes an integral flange 44 for connection of the nozzle to connecting piping 46 from the radiators 18. The head pipe 36 also includes a flange 48 for connection of the head pipe to the tank lower flange 38.

In a preferred embodiment, the diffuser pipe defines a passage 50 having a cross-sectional area about 2.75 times the cross-sectional area of the nozzle outlet end. Depending upon the operating characteristics of the cooling system, the diffuser to nozzle outlet area ratio may be varied to obtain a desired pressurization of the cooling system, especially at the pump inlet. In similar engine cooling systems, this ratio may reasonably range from about 2/1 to about 3.5/1.

In operation of the cooling system 10, the centrifugal impeller, not shown, of the coolant pump 14 is rotatably driven by the engine 12. Cooling water, or other coolant such as water with antifreeze, is drawn into the pump inlet and accelerated radially to increase the coolant pressure for delivery to the engine coolant passages 16 for cooling internal engine components. The heated coolant is passed through radiators 18 where the added heat is rejected to cooling air passed through the radiators. The coolant is then returned to the pump inlet through the cavitation suppressor 26 and flexible coupling 28 for recirculation through the system 10.

As the coolant is passed through the suppressor 26, the coolant is efficiently accelerated in the conical nozzle 30 and is projected at an accelerated velocity into the inlet end 34 of the diffuser pipe 26 to which the head pipe 36 is connected. The coolant in the water tank, acting through the head pipe 36, forms a static pressure head, which establishes the static pressure of the coolant entering the diffuser. Then, as the accelerated stream of coolant decelerates in the diffuser, some of the kinetic energy in the stream is converted to additional static pressure, thereby increasing the static pressure at the inlet of the pump as well as throughout the cooling system. The increased pressure at the pump inlet is effective to suppress the occurrence of cavitation in the inlet to a higher temperature than without use of the suppressor. With the absence of cavitation, the pump is able to provide higher flow rates with a higher pump outlet pressure. The suppressor not only suppresses cavitation at the pump inlet, but also throughout the cooling system.

In fabrication of the suppressor 26, the three components, nozzle 30, diffuser pipe 26 and head pipe 36 with welded on flange, are separately fabricated and then welded together into an integral assembly. The simple design of the components and the use of available materials, such as steel pipe, plate and bar stock, limit the cost of manufacture and provide a cost saving together with effective performance of the cooling system over a greater operating range. Other alternative fabrication methods could also be used if desired.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. A cavitation suppressor for connection with an inlet of a coolant pump to increase inlet pressure for controlling cavitation, the suppressor comprising:

a converging inlet nozzle defining an interior passage having reducing cross-sectional areas from an inlet end to an outlet end;

a cylindrical diffuser pipe extending from the outlet end of the nozzle for connection with a pump inlet, the diffuser pipe defining a constant diameter passage having a cross-sectional area larger than that of the nozzle outlet end; and a head pipe connected to the diffuser pipe adjacent the outlet end of the nozzle and defining a head pipe passage, opening to the constant diameter diffuser pipe passage at the nozzle outlet end and adapted for connection with a source of coolant pressure head.

2. A cavitation suppressor as in claim 1 wherein the nozzle, diffuser pipe and head pipe are individual components joined into an assembly.

3. A cavitation suppressor as in claim 1 wherein the nozzle is formed with an integral flange for connection of the suppressor with the coolant circulation system.

4. A cavitation suppressor as in claim 3 wherein the head pipe includes a flange for connection of the suppressor with a coolant tank.

5. A cavitation suppressor as in claim 1 wherein the nozzle passage is conical.

6. A cavitation suppressor as in claim 1 wherein the cross-sectional area of the diffuser pipe passage is in the range of from 2 to 3.5 times the cross-sectional area of the nozzle outlet end.

7. A cavitation suppressor as in claim 6 wherein the cross-sectional area of the diffuser pipe passage is in the range of from 2.7 to 2.9 times the cross-sectional area of the nozzle outlet end.

8. An engine cooling system comprising:

an engine having internal cooling passages;

a centrifugal coolant pump connected to deliver coolant to the cooling passages;

at least one heat exchanger connected in series with the cooling passages and an inlet of the pump a coolant tank mounted above the pump inlet; and cavitation suppressor including a diffuser connected with the pump inlet, a converging nozzle having an outlet connected to a larger inlet end of the diffuser to accelerate coolant flow entering the diffuser, and a head pipe connecting a lower portion of the coolant tank with the diffuser adjacent the nozzle to apply a static pressure head of the coolant in the tank to the accelerated coolant flow entering the diffuser to establish a static pressure of the entering flow equal to the static pressure head;

whereby slowing of the coolant flow in the larger diffuser converts dynamic head of the accelerated coolant to increased static pressure at the pump inlet, which increases the suppression of cavitation of the coolant in the pump inlet during operation of the system at increased temperature levels.

9. The invention of claim 8 wherein the cavitation suppressor diffuser is a cylindrical pipe defining a constant diameter passage, and the head pipe passage opens to the constant diameter diffuser pipe passage at the nozzle outlet end.

* * * * *